United States Patent [19]

Traise

[11] 4,007,866

[45] Feb. 15, 1977

[54] WEB TRANSPORT ARRANGEMENT

[75] Inventor: John E. Traise, Lewiston, N.Y.

[73] Assignee: Moore Business Forms, Inc., Niagara Falls, N.Y.

[22] Filed: July 11, 1975

[21] Appl. No.: 595,062

[52] U.S. Cl. ..... 226/31; 226/111; 226/195

[51] Int. Cl.[2] ..... B65H 23/18

[58] Field of Search ..... 226/30, 31, 28, 29, 226/42, 9, 111, 195; 101/181

[56] References Cited

UNITED STATES PATENTS

| | | | |
|---|---|---|---|
| 3,025,791 | 3/1962 | Auerbacher | 101/181 |
| 3,179,045 | 4/1965 | Evers | 101/181 |
| 3,841,216 | 10/1974 | Huffman | 226/30 X |

*Primary Examiner*—Evon C. Blunk
*Assistant Examiner*—Bruce H. Stoner, Jr.
*Attorney, Agent, or Firm*—Watson, Cole, Grindle & Watson

[57] ABSTRACT

A web transport arrangement is devised for transporting a web material along a web path. The web material is supplied by a variable feed mechanism to a processing mechanism for processing the web. The web material while being metered by the feed mechanism is maintained by the mechanism under a low tension although the web may be maintained under a high tension during subsequent processing operations. A control circuit automatically compares the feed rate of the web through the low tension feed area to the rate of the processing mechanism operative on the web within the processing area and provides for any necessary modification of the infeed rate in order to synchronize them.

12 Claims, 6 Drawing Figures

CONTROL GATE
30
Z
GATE
29
RESOLUTION SELECTOR
28
COUNTER
27
38
DC/AC CONVERTER
22
TACH. GEN.
21
13
COMPAR-ATOR
26
26a
26b
26c
COUNTER
31
IMAGE REPEAT SELECTOR
32
25'
24'
23'
14
6
8
12
15
12"

WEB TRANSPORT ARRANGEMENT

BACKGROUND OF THE INVENTION

The present invention relates to an improved web transport arrangement for synchronizing the feed rate of a web into a processing area with the rate of processing by said processing mechanism.

The need for an accurate automatically controlled web transport system becomes especially significant in the production of long lengths of certain web materials. One exemplary type of operation in which such an accurate control becomes highly desirable is in a rotary web-fed business forms printing press where a web which has been previously printed or processed is to be reprinted or reprocessed in order to perform second (or successive) operations in mutual registry with the results of the previous operation. Another exemplary type of operation in which it is beneficial to utilize an accurate control system is in the control of displacement feed of a web to effect metering over long lengths to assure accurate sheet lengths without the need for manual adjustment, regardless of the caliper of the web and without the undersirable effects of varying web tension within the processing mechanism.

In the production of such long lengths of web materials, even if only a slight difference exists between the operational rate of the processing apparatus and the rate of feed of the web, this difference over a great number of repeated operations can become relatively significant. Such a difference can result, for example, from a variation in the caliper of the web, or variations in the calipers of various webs utilized. If, for example, the web material is fed at too slow a rate, then the web material may be excessively stretched in the processing area. On the other hand, if the web material is fed at too fast a rate, then the tension of the processing area will not be great enough for proper registration between the processing equipment and the web material.

When a long length of web material, such as for the production of several hundred or thousand sheets, is produced in this manner, a minute difference between the feed rate of the web and the movement of the processing equipment can accumulate into a significant error if not corrected. A difference of a 100th of an inch, for example, will eventually mount up so as to result in the printed material being printed on the wrong section of the web. If this occurs, then when the web material is later cut into equally sized sheets, a portion of the printed material will be cut off, for example, from the bottom of one sheet and will be present at the top of the next sheet. Accordingly, in order to overcome this problem of synchronization in the processing operation, accurate control of the feed rate of the web becomes necessary.

An additional problem for consideration, is to provide for such an accurate control of the web feed without the necessity of utilizing a plurality of feed holes in a feed hole strip along the side of the web material with a corresponding pin feed device. The utilization of feed holes strips along the sides of the web merely constitutes waste paper in the final product. Hence, it would be desirable to eliminate the necessity of having such feed hole strips along the sides of the webs. For this purpose, it is necessary to eliminate the necessity of utilizing a pin feed device to accurately control the movement of the web material.

A separate feed mechanism is generally provided for controlling the rate of movement of the web material along the feed path in a direction towards the processing mechanism. While the web as it passes through the processing area is generally maintained at a relatively high tension, the web as it passes through the feed section is preferably maintained at significantly lower tension. For this reason, a tension-isolating mechanism is provided for separating the feed and processing areas. A web transport arrangement of this type is described in my copending U.S. application Ser. No. 459,175, filed Apr. 8, 1974, now abandoned, which application was replaced by a continuation application, Ser. No. 598,288, filed July 23, 1975, and now U.S. Pat. No. 3,995,373 which is commonly owned herewith; the subject matter of said patent being incorporated herein by reference.

In one of my earlier developments, a compensated displacement drum is provided for metering, at low tension, a web of paper into the high tension processing area. The rate of displacement of this metering drum can be altered to maintain accurate sheet length displacement as the caliper of the web varies. In accordance with such development, compensation for any expected incremental displacement change of a particular web is manually accommodated by utilizing change gears for incrementally correcting the feed rate of the drum. This incremental variation is calculated and gears changed according to the caliper of the web being fed. While such a web metering arrangement makes it possible to establish a basic sheet length accuracy, the system is not self-correcting as paper caliper varies and hence the previously mentioned problems could still exist to a limited extent.

Furthermore, while the system of my prior development provides for a manual procedure for compensating for incremental changes in the feed rate of the web, it would be desirable to provide a feed system in which the web being fed can be automatically compensated for feeding displacement, without the necessity of attendance by an operator. Previously known mechanisms for accomplishing such an automatic compensation rely on the correction of the feed rate by varying either the infeed ratio or by varying the web tension at the metering mechanism, but they exhibit the undesirable characteristic of varying the web tension at the infeed metering mechanism and also effecting corresponding tension changes in successive stages of the processing mechanism. The effect of such variations in the tension within the processing mechanism causes variations in color-to-color or print-to-punch operations as the web elastically elongates or contracts under the varying tension.

SUMMARY OF THE INVENTION

An object of the present invention is to provide an improved web transport arrangement.

Another object of the present invention is to provide a control system for automatically synchronizing the rate at which the web material is supplied to a processing area with the rate of processing of the web material.

A further object of the present invention is to provide for the metering of a web material at a precise rate of displacement into a high tension web processing mechanism, with the feed rate being synchronized with the processing rate, without causing any variance in the web tension within the area of the infeed metering mechanism.

Still another object of the present invention is to provide a transport arrangement in which the feed rate can be automatically self-corrected without the requirement for any changing of gears or other manual controls, regardless of the caliper of the paper or type of metering length reference.

In order to accomplish the above objectives, in accordance with the present invention, an arrangement is provided for automatically comparing the rate of movement through the feed area with the rate of processing of the processing mechanism and compensating for any differences in these rates by adjusting the rate at which the web material is fed to the web path. This compensation in the feed rate of the web is carried out while maintaining the level of the low tension within the feed area and the level of the high tension within the processing area.

The web transport arrangement includes a feed mechanism which is provided for the metering of a web material at a precise rate of displacement into a high tension web processing mechanism with the feed rate being synchronized with the processing rate, without causing any variance in the web tension within the area of the infeed metering mechanism.

The web transport arrangement includes a feed mechanism which is provided for supplying the web material along a web transport path to a processing mechanism. The web material as it passes through the feed mechanism is maintained under a relatively low tension. A first sensor is arranged in operative relationship with the low tension area for providing a first series of signals which are dependent upon the rate of movement of the web material through this area. A second sensor is arranged along the web path at a position outside of the low tension area for providing a second series of signals dependent upon the processing rate. These first and second series of signals are compared by a control circuit which determines the synchronization of such signals. In response to such comparison, the control circuit provides a series of control signals when one of the first and second series of signals precedes the other. These control signals are then provided to a variable ratio control of the feed mechanism for varying the feed rates of the web material relative to the feed rate of the processing mechanism.

In a first embodiment of the present invention, a first sensor, which can be a focused photo-electric device capable of sensing printed or mechanically applied indicia marks on the web with the specific resolution required, is disposed above the advancing web material. The series of signals which are provided by this first sensor may be in the form of electrical pulses or steps. A second sensor is arranged in operative relationship with the processing mechanism for generating a second series of cyclic pulses indicative of the processing rate. It is these first and second series of pulses which are compared by the control circuit. The spacing of the marks along the advancing web is such so as to provide a series of pulses which should be identical with the cyclic signal repeat of the processing mechanism, or some multiple thereof, so as to make it possible to obtain the desired synchronization within the limits of control of the web with the processing mechanism. Additionally, a reset sensor can be provided adjacent the first sensor for sensing the same indicia marks and generating a corresponding series of reset signals. These reset signals are again provided to the control circuit for resetting the control circuit.

In a second embodiment of the present invention, a platen is arranged within the low tension area for providing a straight guide surface over which the web material travels and a free wheeling roller is arranged adjacent the platen so as to travel on the opposite side of the web material from the platen. In this manner, the roller is freely rotated by the straight line movement of the web material, and rotary displacement of the roller is proportional to the linear displacement of the web without regard to the absolute caliper or any caliper variations in the web. The roller has an indicia mark on its peripheral surface. The first sensor is arranged adjacent the roller so as to sense this indicia mark as the roller rotates and in response to the sensing indicia mark to provide a first series of signals. In addition to generating the first series of signals to be supplied to the control circuit, a reset sensor is also provided for sensing the indicia mark on the roller for generating a series of reset signals for resetting the control circuit.

In either embodiment the second sensor is arranged within the processing mechanism. The processing mechanism can include, for example, a processing drum, such as a printing drum, which is arranged along the web path. The web material then passes over this drum as the drum rotates. At least one indicia mark is provided on the processing drum. This indicia mark on the drum constitutes a reference indicia. The second sensor is arranged adjacent the drum so as to sense the reference indicia on the web and in response to the rotational movement of the reference indicia generates the second series of signals thereby providing signals indicative of the processing rate of the web material.

In a further embodiment, it is possible to arrange the reset sensor adjacent the second sensor. The reset signals are then generated in response to the reference indicia on the processing drum.

The control circuit for use in the above-mentioned systems includes a logic circuit which provides a first series of logic signals when the signals from the first sensor precedes the signals from the second sensor and alternatively provides a second series of logic signals when the signals from the second sensor precedes the signals from the first sensor. Consequently, this logic gating circuit provides an indication of the phase polarity of the two series of sensing signals and also enables the gate which will be used to determine the magnitude of the displacement between the signals. A counter circuit is provided in the control circuit for gating the logic signals of either series and generating an actuating signal each time a set number of logic signals have been counted. The logic signals are supplied by a pulse generator which provides a pulse output in correspondence with a finite length of web displacement, such as, for example, 0.0005 inches. The resulting series of logic signals is utilized to produce a pulse chain of higher resolution which is fed into the binary counter in conjunction with said gating signals. Through the setting of a resolution selector, it can be determined at which stage of the counter an output will be provided, hence each successive stage of the counter corresponds to a coarser resolution. Thus, the pulse chain entering the first stage is at the same cyclic rate as the pulse generator, for the cited example, one pulse per 0.0005 inches of paper traveled. The following stages of the counter would correspond to a frequency of one pulse per 0.001 inches and a frequency of one pulse per 0.002 inches, and so on to whatever resolution is required.

A control gate is coupled to the counter and the logic circuit for providing control signals in response to coincidence of the actuating signals and the logic signals. These control signals are indicative of whether the control signals from either the first or second sensor precedes the signals from the other. In this manner, the control signals, which are fed back to the variable drive mechanism for controlling the feed mechanism, indicate whether the web material is being fed at a slower or faster rate than the rate of the processing mechanism. The drive mechanism is adjusted in response to these signals so as to provide proper compensation for any differences between the feed rate and the processing rate.

In a further embodiment of the present invention, it is possible to compensate for any error signals which could be generated by the existence of multiple reference indicia on a processing drum. In this regard, it is noted that an actual document length could be only some sub-multiple of the circumferential length of the processing drum. Thus, for example, the actual document length being processed could be 5-½ inches while the processing drum could include four images on a 22 inch circumferential length. Since each plate would be identically produced, each would probably have a separate reference mark thereby causing a multiple number of marks for each revolution of the processing drum. In order to eliminate the shorter multiple document lengths not coincident with the basic cylinder size, it, therefore, is desirable that the only web pulse considered in the logic circuit is the first, fifth, ninth, etc., in order to match the cylinder repeat from which the web was originally printed or marked with the indicia marks.

In order to compensate for such multiple signals, the reset sensor can be located adjacent the processing drum. The reset sensor would then sense the multiple number of marks for each revolution of the drum. These signals are accordingly counted and fed to a second counter. This counter only provides an output signal after a set number of signals is counted, this set number being determined by an image repeat selector. The output signals from the second counter are then provided to a gate circuit along with the output signals from the counter coupled to the logic circuit. It is the output from this gate circuit which is then fed to the control gate along with the actual logic signals. The control gate, as before, provides the series of control signals.

DESCRIPTION OF THE PREFERRED EMBODIMENTS

Figure 1:
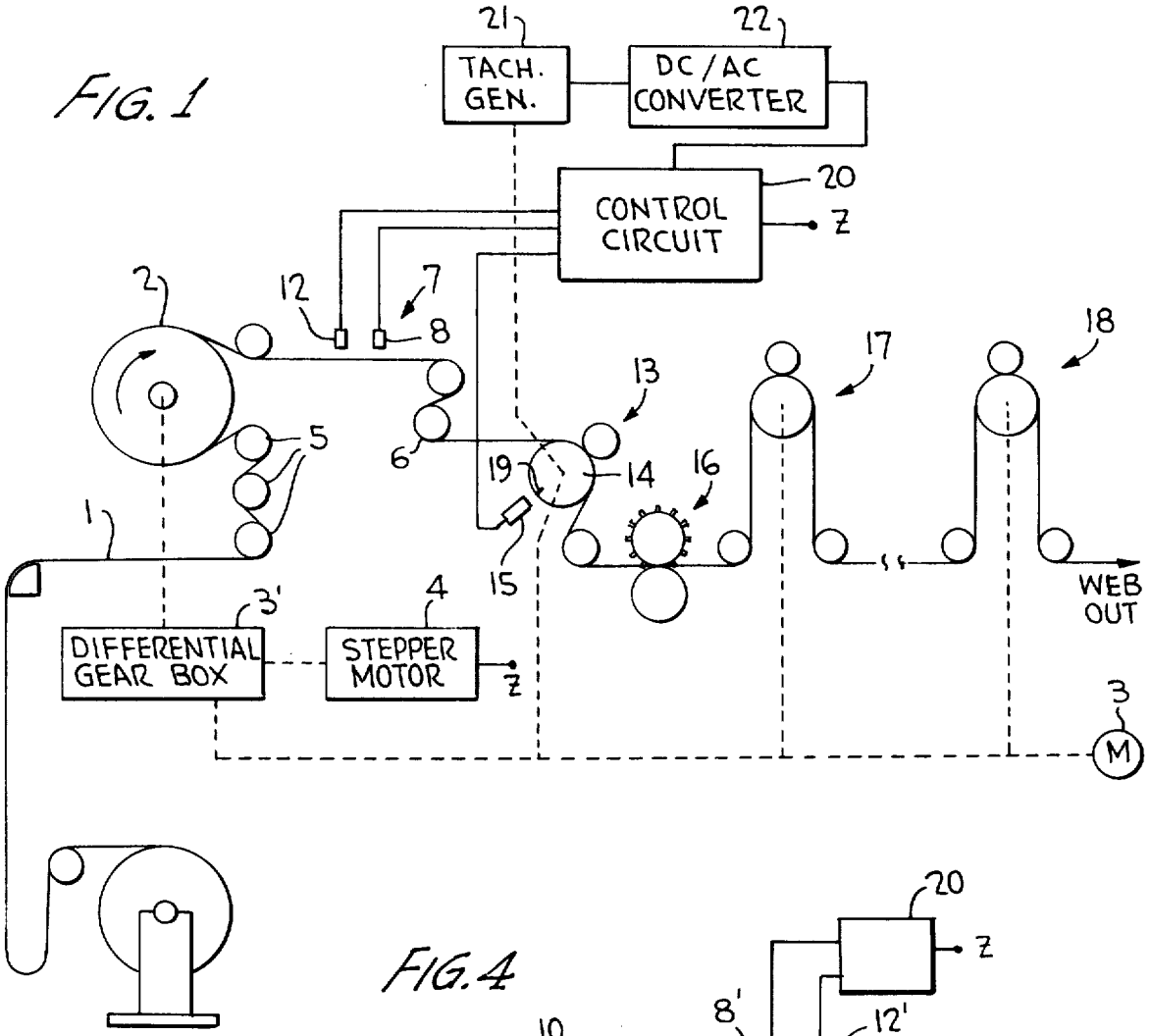
FIG. 1 is a schematic illustration of a web transport arrangement in accordance with the present invention.

A web material 1 is supplied from a supply roll over a set of guide bars or rollers 5 along a web transport path to a feed mechanism including a metering drum 2, as illustrated in FIG. 1. Metering drum 2 is driven by a drive mechanism including a main drive motor 3, a differential gear box 3' and a stepper motor 4. This drive mechanism drives the metering drum at a preselected speed so as to feed the web material 1 at a predetermined rate. The web material is maintained within the area of the feed mechanism at a tension lower than the tension of the web material in the subsequently arranged processing area downstream of the metering drum in the direction of web travel. In order to isolate this low tension area from the downstream high tension processing area, a set of isolating tension bars or rollers 6 are provided similarly in the manner and for the purpose as described in my above-mentioned co-pending application Ser. No. 459,175 now abandoned.

The differential gear box 3' in addition to providing the main driving force from the motor 3 to the metering drum 2, for driving the metering drum at a pre-selected speed, is capable of acting in cooperation with the stepper motor 4 for providing secondary compensation of the drive speed ratio of the metering drum. In regards to such compensation, it is possible to utilize within this gear box a step-down gear reduction so that the variable component of the gear box ratio represents only a minute portion of the speed variation when coupled to the metering drum. The procedure for providing for such variation in the drive speed of the metering drum and hence the feed rate for the web material will be further described below.

Figure 6:
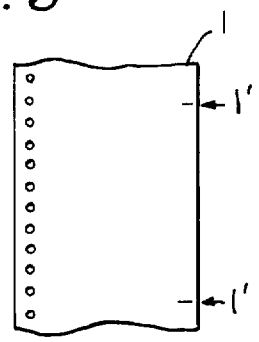
FIG. 6 is a partial plan view of a web material for utilization in the embodiment of the preset invention illustrated in FIG. 1.

A mark sensor arrangement 7 is provided within the low tension area for producing a series of signals indicative of the rate of movement of the web material through this area, i.e., the feed rate of the web material. In order to determine the rate of movement, web material 1 is provided with a plurality of equally spaced indicia marks 1', as shown in FIG. 6. A first sensor 8 is arranged for sensing the indicia marks 1' and generating in response to these marks a first series of signals. This first series of signals, therefore, constitutes a series of web advance signals as the feed of the web material proceeds. The web advance signals are supplied from sensor 8 to a control circuit 20. A reset sensor 12 also is provided in this first sensing area 7 and in the same manner as first sensor 8, reset sensor 12 generates a series of reset signals in response to the linear movement of indicia marks 1'. The reset signals are also fed to control circuit 20.

As the web material leaves the feed mechanism, it enters into various processing stages 13, 17 and 18 at which the same or different web processes may be carried out. As previously mentioned, within these web processing areas, it is usually desirable or necessary to maintain the web material under a relatively high tension so as to insure proper web control and registration subsequently with the processing equipment.

As the impression drum 14 of processing unit 13 rotates, a second series of signals are generated by a second sensor 15. For descriptive purposes, cylinder 14 is depicted with a reference indicia 19. As cylinder 14 rotates, sensor 15 senses the rotational passage of reference indicia 19 so as to generate a series of reference signals which are fed to control circuit 20.

It is also optional within the processing area to provide a set of roller punches 16 for punching a set of holes along one or both sides of the web material. While the utilization of an accurate metering and feedback controlled means for feeding the web material to the processing areas eliminates the need within the feed process for having a set of guide holes within the web material, it might still be necessary for carrying out subsequent web processing operations to have a set of registration holes within the material. If such holes are required for either such a purpose or for any other purpose, then a set of roller punches 16 can be provided. One possible utilization for such holes would be for use in collating multiple part manifolds after the component webs of material are prepared in roll form. It is again noted, however, that for operating the web transport arrangement of the present invention, the utilization of such feed holes are entirely unnecessary, either in preparing the web initially or in successive re-registration requirements which may be desired.

Figures 2, 5:
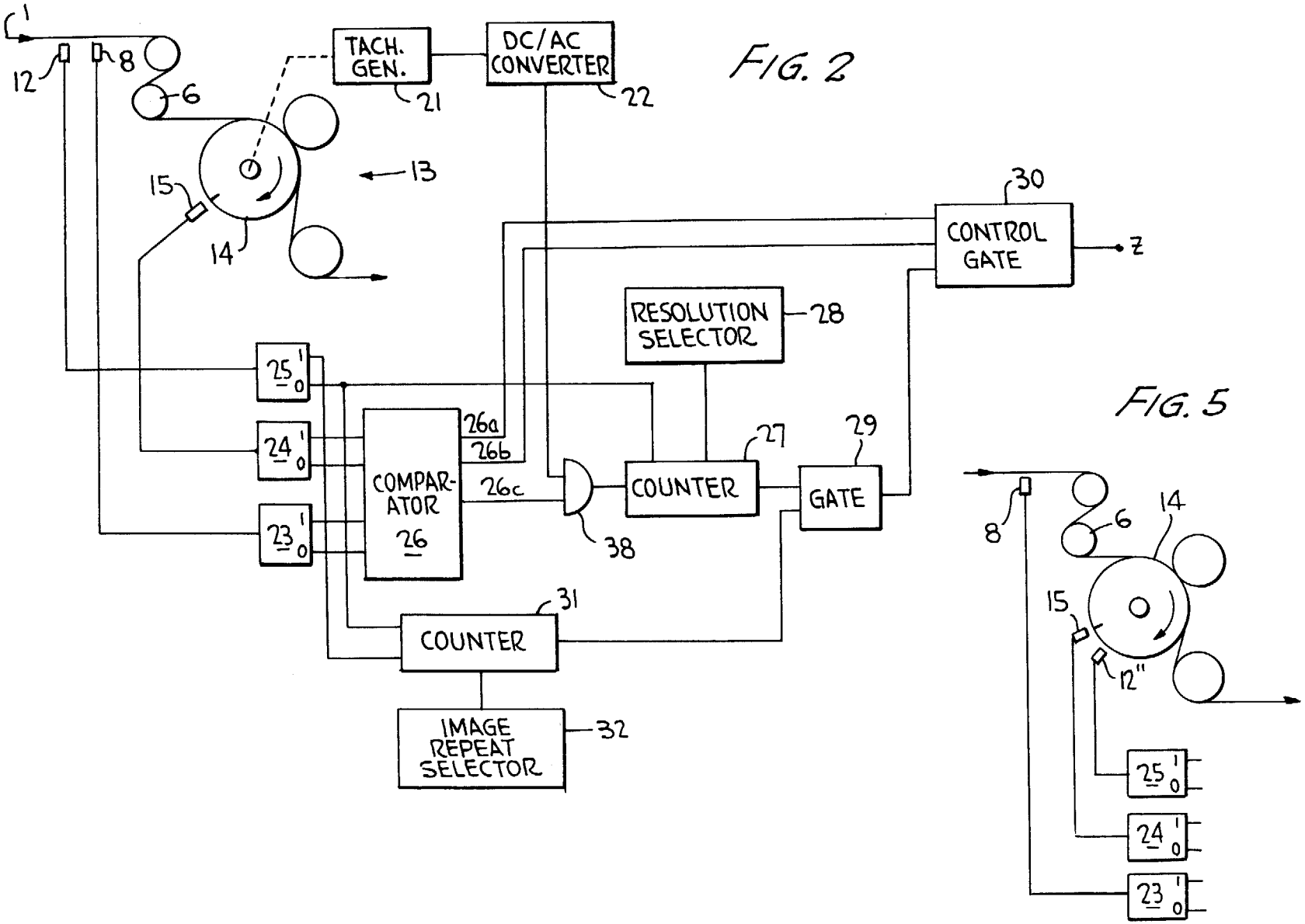
FIG. 2 presents a block circuit diagram of the control circuit for the web transport arrangement illustrated in FIG. 1 in accordance with the present invention.
FIG. 5 is a schematic view of a portion of a second embodiment of the transport arrangement illustrated in FIG. 1.

As illustrated in FIGS. 1 and 2, control circuit 20 receives four separate input signals. The first three of these signals are the web advance signals from sensor 8, the reset signals from sensor 12 and the press advance signals from sensor 15. Control circuit 20 also receives a series of reference pulses. These reference pulses are produced via a tachometer generator 21 and a dc/ac converter 22, which are coupled to processing drum 14. The reference pulses could be produced, for example, at a rate corresponding to 2,000 pulses per inch of advance of the web material, i.e., one pulse for every 0.0005 inches, through the processing area.

Referring to FIG. 2, the signals from sensors 8, 12 and 15 are respectively fed to corresponding flip-flop circuits 23, 25 and 24. The outputs from flip-flop circuits 23 and 24 are supplied to a comparator 26. The comparator compares the first series of signals, the web advance signals, with the second series of signals, the press advance signals. Upon such a comparison, comparator 26 provides either the first or second series of logic signals on output lines 26*a* or 26*b*, respectively. The first series of logic signals indicate that the web advance signals precede the press advance signals or a web leading condition. The second series of logic signals indicate that the press advance signals precede the web advance signals or a web lagging condition. Regardless of which of these two conditions exist, assuming one does exist, an output signal will be provided on output line 26*c* from the comparator, the length of which is proportional to the error between the press reference signal and web signal. If the web advance signals and press reference signals are completely synchronized, then there will be no output from comparator 26.

The displacement error signal from line 26*c* is "AND" gated with the generator signal from the press speed converter 22 and enters a binary counter 27. After counting a string of error-indicative pulses admitted by a gate 38, the counter provides an output. This output is controlled by the resolution selector, which is manually preset to permit the counter output according to the error control desired.

An additional limiting control of the error signals output also is necessary, since the diagrammatically shown processing drum 14 may be several multiples longer in circumferential length than the length of each image repeat, and the accompanying registration web advance mark, on the web. To eliminate mechanically oscillating errors due to runouts oof cylinders, etc., it is therefore desirable to admit only those error signals which are generated at a datum position of the processing mechanism. Accordingly, as shown in FIG. 2, a second counter 31 is provided which may be preset by image repeat selector 32 to match the multiple image repeat of the particular geometry involved. Counter 31 is triggered by reset pulses from sensor 12.

The output of counters 27 and 31 are then gated at "AND" gate 29, which provides a unit pulse. This pulse, which indicates an error exceeding whatever resolution is selected, then is combined with the phase polarity signals on lines 26*a* or 26*b*, previously described, into gate 30 to provide a polarized signal output Z which is used to bidirectionally actuate the correction device, which in conjunction with stepper motor 4 of FIG. 1 incrementally adjusts the speed ratios of differential gear box 3'.

Figure 3:
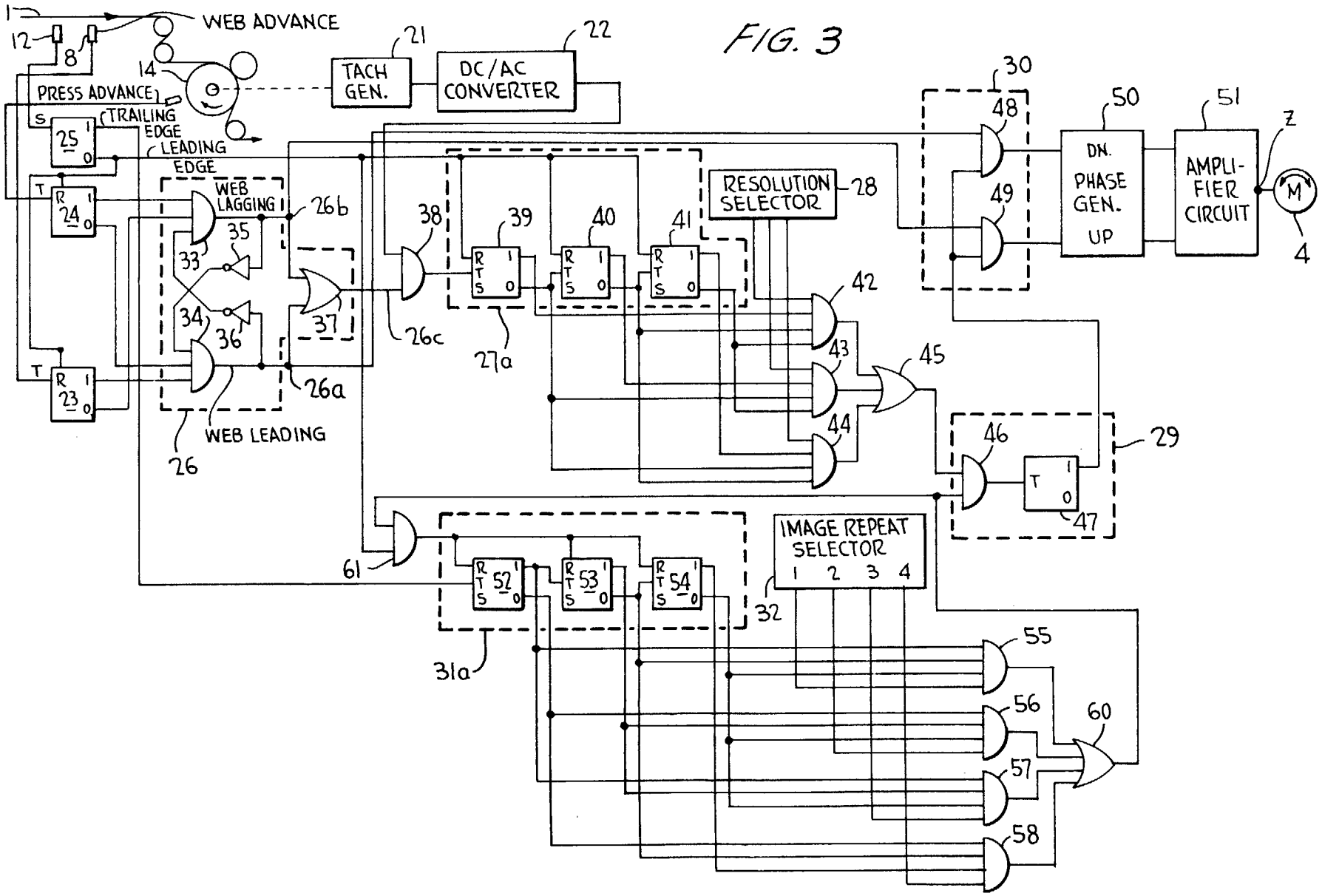
FIG. 3 is a schematic circuit diagram of the control circuit illustrated in FIG. 2.

A more detailed schematic circuit diagram of the control circuit illustrated in FIG. 2 is provided in FIG. 3. As shown in FIG. 3, the outputs of flip-flops 23 and 24 are connected to AND-gates 33 and 34. The output of AND-gate 34 is connected through an inverter 36 to an input of AND-gate 33; likewise, the output of AND-gate 33 is coupled through an inverter 35 to an input of AND-gate 34. In this manner, AND-gate 34 provides a first series of logic signals when the web advance signals precede the press advance signals providing there are no output signals at the output of AND-gate 33. Similarly AND-gate 33 provides a second series of logic signals when the press advance signals precede the web advance signals, providing there are no output signals at the output of AND-gate 34. The output signals of both AND-gates 33 and 34 are fed to an OR-gate 37 which provides a series of signals along line 26*c* indicative of each comparison between the web advance and press advance signals.

The signals along line 26*c* are fed via AND-gate 38 to a counting circuit 27*a* of counter 27. Additionally the web displacement signals from generator 22 are also fed to AND-gate 38. Counting circuit 27*a* includes a plurality of counting stages 39, 40 and 41 which are coupled to AND-gates 42, 43 and 44, respectively. These AND-gate are also respectively coupled to the various outputs of resolution selector 28. The outputs of all of the AND-gates are coupled to an OR-gate 45.

Reset flip-flop 25 provides a first signal at its 0 terminal in response to the leading edge of a reset mark and a second signal at its 1 terminal in response to the trailing of the reset mark. Reset flip-flop 25 is connected in such a manner that the two counting circuits 27*a* and 31*a* are reset at the desired time for each correction cycle, and in addition the reset pulse trailing edge also is used to pulse image repeat counting circuit 31*a*. Considering the image repeat selector first, the logical 1 output of flip-flop 25, which is the trailing edge of the reset mark on the web, is coupled to counting stage 52 of counter 31. The 0 terminal which is the leading edge of the reset mark on the web, is coupled through AND-gate 61 to the reset terminal of each of counting stages 52, 53 and 54 of counter 31, and to detector flip-flops 23 and 24. The outputs from counting stages 52, 53 and 54 are coupled to AND-gates 55, 56, 57 and 58. Additionally, the outputs from image repeat selector 32 are also coupled to these AND-gates. The output of each of the AND-gates are coupled to OR-gate 60. Thus, OR-gate 60 only provides an output signal after a set number of reset signals has been counted, this set number being that number selected by the image repeat selector. The output from OR-gate 60 is fed along a feed back path to AND-gate 61 which in turn resets each of the counting stages of counter 31 after an output has been produced from the counter.

An AND-gate 46 and a one-shot, or monostable, multi-vibrator 47 from gate circuit 29. AND-gate 46 is coupled to receive the output signals from both OR-gates 45 and 60. Upon coincidence of such output signals, AND-gate 46 provides a signal to activate one-shot multi-vibrator 47 which in turn provides an output pulse of constant duration, which is coupled to control gate 30.

Control gate 30 includes AND-gates 48 and 49, a phasing generator 50 and output amplifier circuit 51, to time the correction stepper motor 4. AND-gate 48 receives both the output from multi-vibrator 47 and the "web leading" logic signal from line 26*a*. In response to coincidence of such signals, AND-gate 48 provides a signal to the down, or decrease, terminal of the phasing generator 50, which in turn provides output signals of such polarity for indicating that the feed rate of metering drum 2 should be decreased. AND-gate 49 receives both the output of multi-vibrator 47 and the "web-lagging" output line 26*b*. In response to coincidence of such signals, AND-gate 49 provides an output signal to the up, or increase, terminal of signal generator 50, which in turn provides an output signal indicating that the feed rate for driving the metering drum should be increased. The correctly phased output signals from generator 50 are fed through amplifier circuit 51, and then to stepper motor 4. Stepper motor 4 can be a bifilar wound stepper motor in which case it would have four control windings. If such a motor is utilized then amplifier 51 provides a separate control signal to each winding, which signal depends upon the directional control to be accomplished.

Figure 4:
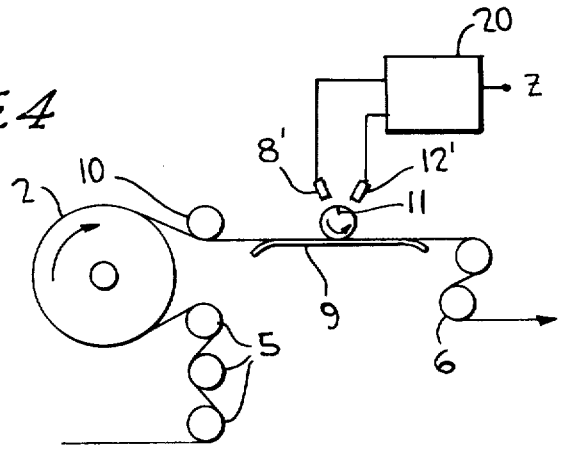
FIG. 4 is a schematic view of a portion of a modified embodiment of the transport arrangement illustrated in FIG. 1.

In an alternative embodiment, as illustrated in FIG. 4, instead of placing the indicia marks on the web material itself, a free wheeling roller 10 with an indicia mark 11 can be utilized. In this arrangement, the web material passes over the surface of a platen. Free wheeling roller 10 is arranged adjacent the platen on the opposite side of the web path such that as the web passes over the platen, roller 10 is rotated by the movement of the web material. A first sensor 8' is arranged for sensing the rotational movement of the indicia mark 11 and generates a first series of signals in response to such rotational movement. This first series of signals constitute the series of web advance signals since the rotational movement of roller 10 directly corresponds to the feed rate of the web material. These web advance signals are supplied from sensor 8' to control circuit 20. A reset sensor 12' is also provided in the same sensing area and in the same manner as first sensor 8', reset sensor 12' generates a series of reset signals in response to the rotational movement of indicia mark 11 on roller 10. The reset signals are also fed to control circuit 20.

In another alternative embodiment, as illustrated in FIG. 5, reset sensor 12'' can be arranged adjacent processing drum 14. In this arrangement, reset sensor 12'' would then be actuated by the reference marks on processing drum 14 in the same manner as second sensor 15. The operation of reset flip-flop 25 and the rest of the control circuitry, however, would remain the same as previously described.

In any of the above embodiments, the various sensors can be either photo-electric or magnetic sensors. If magnetic sensors are utilized, then the indicia marks would be formed of magnetic material. If photo-electric sensors are utilized, the indicia marks can either be actual marks or slits in the web material which enable the passage or reflectance of light through the material.

It is noted that the above description and the accompanying drawings are provided merely to present exemplary embodiments of the present invention and that additional modifications of such embodiments are possible within the scope of this invention without deviating from the spirit thereof.

What is claimed is:

1. A web transport arrangement for transporting a web material along a web path, the arrangement comprising in combination:

variable drive means for supplying a web material from a feed area to the web path and maintaining the web under a low tension while passing through the feed area;

first sensor means arranged in operative relationship with the low tension area for providing a first series of signals dependent upon the feed rate of the web material through the low tension area;

processing means for processing the web material in a processing area and maintaining the web material under a high tension while passing through the processing area;

a second sensor means arranged along the web material path at a position within the processing area for providing a second series of signals dependent upon the processing rate of said processing means;

control means incuding comparison means for comparing said first and second series of signals and providing at its output a first series of control signals when signals of one of said first and second series of signals precedes the other and output means for providing a series of control output signals in response to said first series of control signals;

reset sensor means for generating a series of reset signals to said output means of said control means for controlling the rate at which said control output signals are provided; and, means for coupling said control output signals to said variable drive means for varying the feed rate in response to said control output signals in order to synchronize the feed rate with the processing rate.

2. An arrangement as defined in claim 1 further comprising a platen arranged within the low tension area for providing a guide surface for the web material and a free wheeling roller arranged so as to travel on the opposite side of the web material from said platen and having an indicia mark on its peripheral surface; wherein said first sensor means is arranged adjacent to said roller so as to sense said indicia mark on said roller and to provide said first series of signals in response to the rotational movement of said indicia mark.

3. An arrangement as defined in claim 2 wherein said reset sensor means is arranged adjacent to the web path in the low tension area for generating a series of reset signals in response to the revolution of said indicia mark on said roller and providing said reset signals to said control means.

4. An arrangement as defined in claim 1, wherein the web material is provided with a plurality of equally spaced indicia marks thereon and said first sensor means senses said indicia marks on the web material so as to provide a first series of signals in response to the linear movement of said indicia marks.

5. An arrangement as defined in claim 4 wherein said reset sensor means is arranged adjacent to the web path in the low tension area for sensing the indicia marks and generating a series of reset signals in response to said indicia marks and providing said reset signals to said control means.

6. An arrangement as defined in claim 1 wherein said processing means includes a processing drum over which the web material passes, said processing drum having at least one indicia mark thereon for providing a reference indicia, and said second sensor means is arranged for sensing said reference indicia and providing said second series of signals in response to the rotational movement of said reference indicia.

7. An arrangement as defined in claim 6 wherein said reset sensor means is arranged adjacent to said processing drum for sensing said reference indicia and generating a series of reset signals in response to the rotational movement of said reference indicia and said reset sensor means providing said reset signals to said control means.

8. An arrangement as defined in claim 1 wherein said control means includes: comparison means for comparing said first and second series of signals and providing a first series of comparison signals indicative of which series of signals precedes the other and a second series of comparison signals indicative of each determination; a first counter for counting the signals of said second series of comparison signals and providing a first output count signal after a set number of signals have been counted; a resolution selector coupled to said first counter for setting the set number; a second counter for counting said reset signals and providing a second output count signal after a set number of reset signals have been counted; gating means coupled to receive both said first and second output count signals and upon coincidence of such signals providing gating signals; and a control gate coupled to receive said gating signals and said first comparison signals and upon coincidence of such signals providing said control signals.

9. A web transport for transporting a web material along a web path, the arrangement comprising in combination:

variable drive means for supplying a web material from a feed area and maintaining the web under low tension while passing through the feed area;

first sensor means arranged in operative relationship with said low tension area for providing a first series of signals dependent upon the feed rate of the web material through said low tension area;

processing means for processing the web material in a processing area and maintaining the web material under a high tension while passing through the processing area;

second sensor means arranged at a position within the processing area for providing a second series of signals dependent on the processing rate of said processing means; and, control means including; a logic circuit for providing a first series of logic signals when the signals of said first sensor precedes the signals of said second sensor and providing a second series of logic signals when the signals of said second sensor precedes the signals of said first sensor, a counter for counting the signals of said first and second series of logic signals and causing the generation of actuating signals each time a set number of logic signals have been so counted; and an output gate coupled to the outputs of said counter and said logic circuit for providing control signals in response to said actuating signals and said first and second series of logic signals, said control signals being indicative of which of the signals of said first and second series precedes the other; and means for coupling said control signals to said variable drive means for varying the feed rate in order to synchronize the feed rate with the processing rate.

10. An arrangement as defined in claim 9 further comprising reset sensor means for generating a series of reset signals in response to said web movement in said feed area and providing said reset signals to said control means for controlling the rate at which said control signals are provided.

11. An arrangement as defined in claim 9 further comprising a platen arranged with said low tension feed area for providing a guide surface for the web material and a free wheeling roller arranged so as to travel on the web surface opposite from said platen and having said first sensor indicia mark on its peripheral surface; wherein said first sensor means is arranged adjacent to said roller so as to sense said indicia mark on said roller and to provide said first series of signals in response to the rotational movement of said indicia mark.

12. An arrangement as defined in claim 11 further comprising reset sensor means for generating a series of reset signals in response to the revolution of said indicia mark on said roller and providing said reset signals to said control means.

* * * * *